United States Patent [19]

Braconnier et al.

[11] 4,159,146

[45] Jun. 26, 1979

[54] CHAIRS

[75] Inventors: Daniel Braconnier, Ecully; Silvio Sangalli, Caluire; Joseph Puthon, Lyons, all of France

[73] Assignee: Rhone-Poulenc-Textile, Paris, France

[21] Appl. No.: 806,158

[22] Filed: Jun. 13, 1977

[30] Foreign Application Priority Data

Jun. 16, 1976 [FR] France ..... 76 18508

[51] Int. Cl.[2] ..... A47C 3/02

[52] U.S. Cl. ..... 297/258; 297/272; 297/285; 297/455

[58] Field of Search ..... 297/454–456, 297/258, 272, 285, 288

[56] References Cited

U.S. PATENT DOCUMENTS

| | | | |
|---|---|---|---|
| 3,041,070 | 6/1962 | Kerstein | 297/258 X |
| 3,127,221 | 3/1964 | Bennett | 297/454 |
| 3,526,429 | 9/1970 | Metzger | 297/258 |
| 3,669,496 | 6/1972 | Chisholm | 297/455 X |
| 3,967,852 | 7/1976 | Eselt et al. | 297/455 X |

*Primary Examiner*—James C. Mitchell

*Attorney, Agent, or Firm*—Sherman & Shalloway

[57] ABSTRACT

A chair is disclosed which includes a filled seat portion and a filled back portion joined by a unitary, non-articulated semi-rigid connection integral with the seat portion and the back portion, the connection having a rebate therein, for example in the form of a step, a triangle, an arc, or a continuation thereof.

5 Claims, 13 Drawing Figures

CHAIRS

The present invention relates to chairs. In the present specification, the term "chairs" is intended to cover any form of chair, armchair, settee, bed settee, automobile vehicle seat, etc. having a set portion and a back portion.

Chairs generally include a seat portion and a back portion which are formed separately from the part intended to engage the ground. The set portion and back portion are, in most cases, fixed together in a rigid manner so that they extend generally at right angles to one another.

One disadvantage of such a structure is that it does not normally allow one to modify the position of the back without taking some manual control action, e.g. operating an adjustment lever. This rigidity renders the chairs uncomfortable, in the sense that the back does not necessarily fit in a physically satisfactory manner to the back of the person sitting.

Chairs, including armchairs and chaise lounges, are also made in which there is a flexible connection between the seat and the back. However, this is usually too supple, presenting a certain discomfort. Furthermore, such chairs cannot be used in all applications. For example, U.S. Pat. Nos. 3,019,051 to Nugent discloses a wire-framed, canvas-surfaced chair which has a tendency to flex in several directions.

According to the present invention, there is provided a chair comprising, as a unitary structure, a filled seat portion and a filled back portion, and a non-articulated semi-rigid connection between the seat portion and the back portion, said connection between the seat portion and the back portion, having a rebate to provide a limited degree of flexure between the back and seat surfaces.

The rebate may be in the form of a right-angle step or several such steps, a triangle or an arc, a combination thereof, or indeed may take many other forms.

The resilient connecting surface of the seat according to the invention is effected in the manner which responds to the well known laws of flexion. It permits the person sitting to make a forward and backward movement of his back, the back surface of the chair moving in a cooperating manner while the seat surface stays substantially fixed, the back thus supporting the person in a manner of a leaf spring.

The connection may be in any sufficiently robust material, for example, wood, metal, and plastics utilized either alone or in combination. The remaining parts of the furniture including the seat, backs, armrest and feet can be composed of the normal materials but they can, if desired, be formed in the same material as the connecting surface.

The connection can be formed as a separate item and rigidly connected to the seat and to the back so that there are three parts in an integral relationship. Alternatively, it can be integrally formed of the same material. It should be understood that the connection between the back and the seat should take into account the laws of flexion, the resistance to flexion, the moment of inertia and the flexion modulus should be calculated according to the known methods as a function of the nature of the material used with respect to its shape, its thickness and its mode of application. The connecting area can also be joined with the arms of the chair and with the seat and/or back, and may also be provided between the seat surface and the element resting on the ground.

A chair according to the present application need not include covers, or if it does, these can be either fixed covers or loose covers.

BRIEF DESCRIPTION OF THE DRAWINGS

In order that the invention may be more readily understood, the following description is given, merely by way of example, reference being made to the accompanying drawing, in which.

DETAILED DESCRIPTION OF THE PREFERRED EMBODIMENTS

Figure 1:
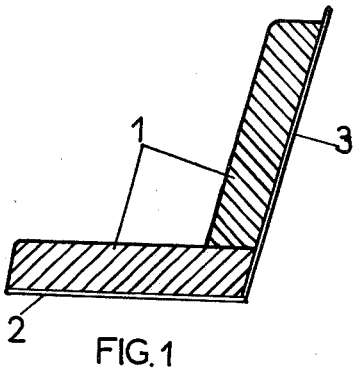
FIG. 1 illustrates one embodiment of a prior art chair.

The conventional chair shown in FIG. 1 includes cushions 1 resting on a seat part 2 and a back part 3, the cushions engaging one another with an overlap. This overlap enables one to use cushions of identical size and yet provide a back and seat of different length. The normal rigid connection of the parts 2 and 3 permits only a slight suppleness of the back part 3.

Figure 2:
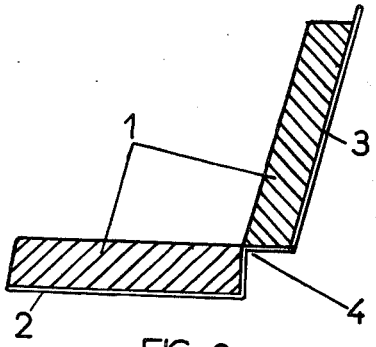
FIG. 2 shows a preferred form of chair according to the present invention and including a right-angular rebate.
Figure 3:
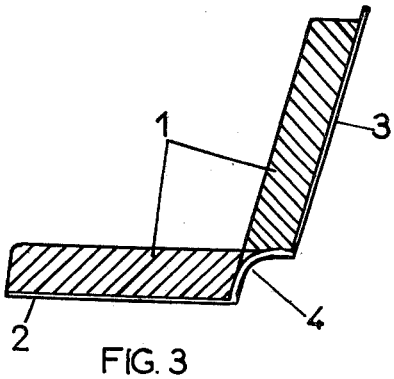
FIG. 3 shows a modified form including arcuate rebate.
Figure 4:
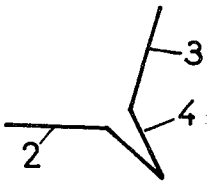
FIG. 4 shows a modified form including a triangular rebate.
Figure 5:
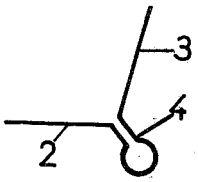
FIG. 5 shows a modified form of arcuate rebate.
Figure 6:
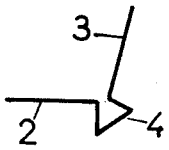
FIG. 6 shows a modified form of triangular rebate.
Figure 7:
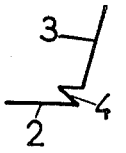
FIG. 7 shows a triangular rebate in an alternate position.
Figure 8:
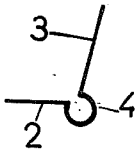
FIG. 8 shows an alternate form of arcuate rebate.

In the constructions according to the invention, the connection 4 between the parts 2 and 3 is in the form of an offset or rebate. In FIG. 2, this rebate is in the form of a right-angle step. In FIG. 3, the rebate is in the form of an arc of a circle, while FIG. 4 shows a triangular rebate. Further embodiments are illustrated in FIGS. 4 to 12.

It will be noted that in FIG. 2 and FIG. 3 the cushions 1 do not overlap one another.

The connection is sufficiently rigid to hold the back portion 3 in an upright condition and sufficiently flexible to permit the back to perform a moderate rearward movement with movement of the person sitting, without causing fatigue at the junction of the back and seat portions.

In the embodiments of FIGS. 4 to 12, the forms of connection 4 have sufficient rigidity to ensure, on the one hand, the rigidity of the connection of the back portion 3 and the seat portion 2, and on the other hand sufficient suppleness to permit the relative movement between the portions 2 and 3.

Figure 9:
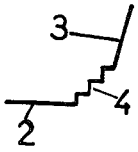
FIG. 9 shows a modified form including plural, right-angular rebates.
Figure 10:
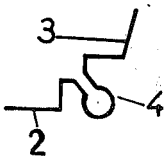
FIG. 10 shows a compound rebate including right-angular and arcuate rebates.
Figure 11:
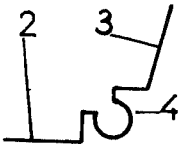
FIG. 11 shows a modified form of compound rebate.

As shown in FIG. 9, the number of rebates in the forms of foldable steps has been increased. These have the advantage of adding to the flexing length of the connecting surface and diminishing the effort which is needed to be applied to the back to obtain a given angle of flexion with respect to the seat, this effect being more or less increased as the number of folds or other profiles are increased.

Figure 12:
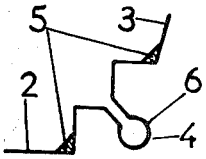
FIG. 12 shows a stiffened form of compound rebate.

It is possible to rigidify local portions of the connecting surface by means of one or several gussets 5, such as is shown in FIG. 12. In this case, the suppleness in the part 6 and the rigidity in the part 5 provide the desired flexing ability.

Figure 13:
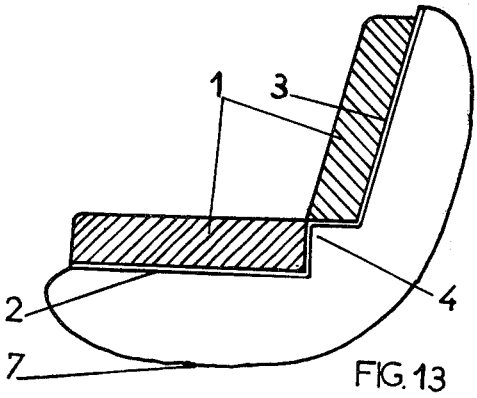
FIG. 13 shows modified embodiment including a flexing rocker mount for the chair.

A further construction is shown in FIG. 13. Here, the assembly is similar to that of FIG. 2, except that there is also a single metallic sheet of stainless steel and of a thickness of about 1 millimeter formed as a loop 7 similar to the arrangement of a conventional rocking chair. In a conventional rocking chair, the contact between the ground is always along a thin transverse line which progresses along the ground according to the movement of the chair. In the construction of FIG. 13, because of the resilience of the member 7, contact between the ground is by a flexed and widened surface, when a person is sitting on the chair, in rather the same manner as the contact between a vehicle tire and the road.

It will be understood that, in all the constructions of FIGS. 2 to 13, the seat portion and the back portions are interchangeable.

The chairs according to the present invention can be conventional chairs without arms, settees, bed settees, armchairs, and finally automobile vehicle seats. One can economize in this latter case, with the construction of the vehicle, with regard to the mounting of the mechanical connection and the control of inclination.

What is claimed is:

1. A chair comprising a unitary structure including
a seat surface portion,
a back surface portion,
a semi-rigid connecting surface portion intermediate and integral with said seat and back portions,
a substantially right-angle rebate formed in said connecting surface portion transversely of the chair, the right-angle of the rebate opening away from the seat and back surface portions whereby the effective flexing length of the connecting surface is substantially extended and an individual sitting in the chair causes said right-angle to flex toward an angle which is less than a right angle, and
a rocker support comprising a sheet spring spanning and spaced from said connecting portion and secured at its opposite ends to said seat and back portions.

2. A chair according to claim 1 in which said sheet spring is secured to the seat portion thereof and to the back portion adjacent the upper portion thereof.

3. A chair according to claim 2 in which the sheet is formed of stainless steel sheet of about 1 millimeter thickness.

4. A chair comprising a unitary structure including
a seat surface portion,
a back surface portion,
a semi-rigid connecting surface portion intermediate and integral with said seat and back portions,
a rebate formed in said connecting surface portion transversely of the chair, and
a rocker support comprising a sheet spring spanning and spaced from said connecting portion and secured at its opposite ends to said seat and back portions.

5. A chair according to claim 4 including interchangeable cushions on said seat and back portions.

* * * * *